US005083773A

United States Patent [19]

Saint

[11] Patent Number: 5,083,773

[45] Date of Patent: Jan. 28, 1992

[54] LOBE SPRING MOTOR FOR CHILD'S SWING

[75] Inventor: David Saint, West Nantmeal, Pa.

[73] Assignee: Graco Children's Products, Inc., Elverson, Pa.

[21] Appl. No.: 573,597

[22] Filed: Aug. 27, 1990

[51] Int. Cl.[5] ..... A63G 9/16

[52] U.S. Cl. ..... 272/86; 185/38

[58] Field of Search ..... 272/85, 86; 297/260, 297/273; 185/38, 39

[56] References Cited

U.S. PATENT DOCUMENTS

| | | | |
|---|---|---|---|
| 34,535 | 2/1862 | Walker . | |
| 320,833 | 6/1885 | Anderson . | |
| 496,531 | 5/1893 | McCurdy . | |
| 579,256 | 3/1897 | Bukolt . | |
| 872,069 | 11/1907 | Kingsbury . | |
| 1,770,152 | 7/1930 | Conlan . | |
| 2,024,855 | 12/1935 | Goetter | 272/86 |
| 2,429,040 | 10/1947 | Zaverl . | |
| 2,807,309 | 9/1957 | Saint et al. . | |
| 2,975,866 | 3/1961 | Worthington . | |
| 2,979,734 | 4/1961 | Saint et al. . | |
| 2,998,612 | 9/1961 | Saint . | |
| 3,030,783 | 4/1962 | Schmidt . | |
| 3,059,725 | 10/1962 | Saint . | |
| 3,071,339 | 1/1963 | Saint . | |
| 3,090,273 | 5/1963 | Fox . | |
| 3,112,814 | 12/1963 | DiPasqua . | |
| 3,361,405 | 1/1968 | Gottlieb . | |
| 3,420,523 | 1/1969 | Foster . | |
| 3,526,400 | 9/1970 | Carpenter et al. . | |
| 3,667,756 | 6/1972 | Barrett . | |
| 3,769,641 | 11/1973 | Harper et al. . | |
| 3,794,317 | 2/1974 | Barrett . | |
| 3,804,407 | 4/1974 | Saint . | |
| 3,806,117 | 4/1974 | Foster . | |
| 4,165,872 | 8/1979 | Saint . | |
| 4,181,299 | 1/1980 | Foster . | |
| 4,371,206 | 2/1983 | Johnson, Jr. . | |
| 4,452,446 | 6/1984 | Saint . | |
| 4,722,521 | 2/1988 | Hyde et al. | 272/86 |

FOREIGN PATENT DOCUMENTS

| | | |
|---|---|---|
| 626739 | 3/1936 | Fed. Rep. of Germany . |
| 368234 | 6/1939 | Italy . |
| 0065437 | 4/1982 | Japan . |
| 0065438 | 4/1982 | Japan . |
| 0065439 | 4/1982 | Japan . |
| 0081528 | 5/1985 | Japan . |
| 1070921 | 6/1967 | United Kingdom . |

*Primary Examiner*—Richard E. Chilcot, Jr.

*Attorney, Agent, or Firm*—Panitch, Schwarze, Jacobs & Nadel

[57] ABSTRACT

A spring motor includes a power spring having a plurality of ends, a multiplicity of coils between the ends and a plurality of lobes defined by the coils. Each lobe includes at least some coils which increase and then decrease in radii to define the lobe. The spring is wound through a spool coupled to one end of the spring and engaged with a crankshaft extending through the spring. A lock clutch on the spool prevents the spring from unwinding through the spool. The escapement permits controlled unwinding of the spring to oscillate the carriage. The remaining end of the spring is coupled to a ratchet wheel which is an escape wheel of an escapement. The spring is supported on a mandrel in the form of a tube coupled to the escape wheel. A plurality of coils at one end of the spring forms a slip clutch which engage the tube to prevent overwinding of the spring. A washer mounted on the tube within the spring prevents remaining coils of the spring from engaging coils of the slip clutch.

20 Claims, 7 Drawing Sheets

FIG. 1
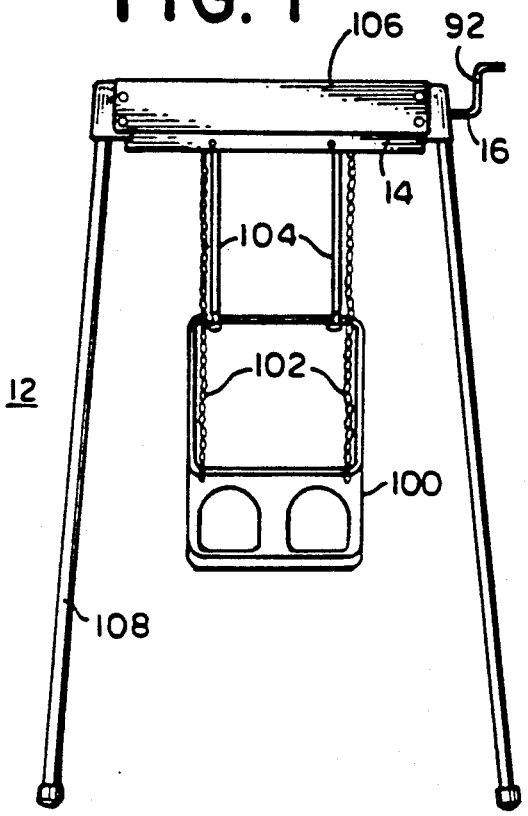
FIG. 7
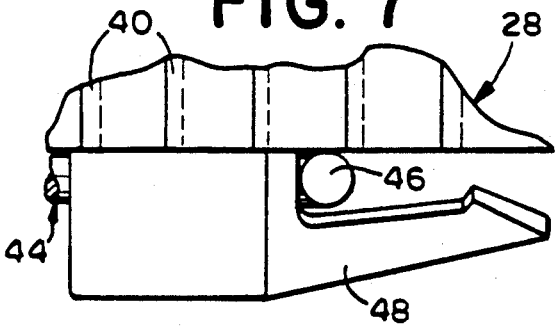
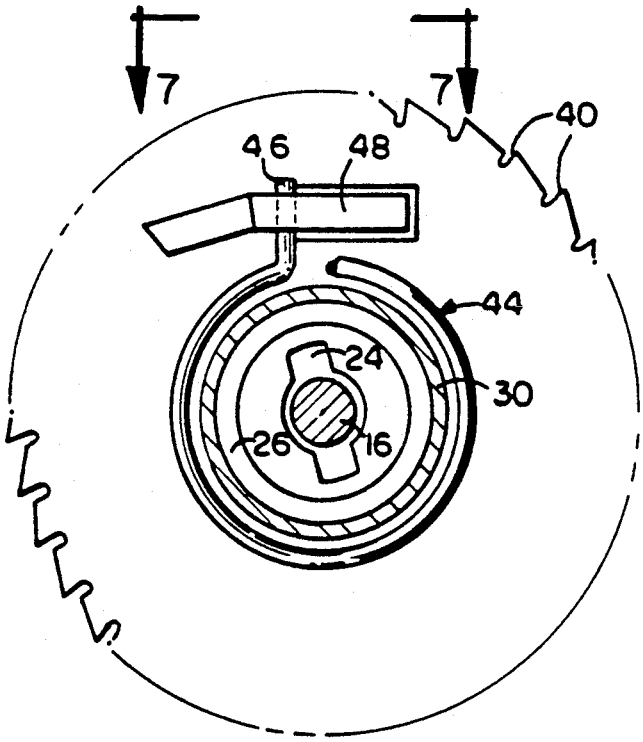
FIG. 6

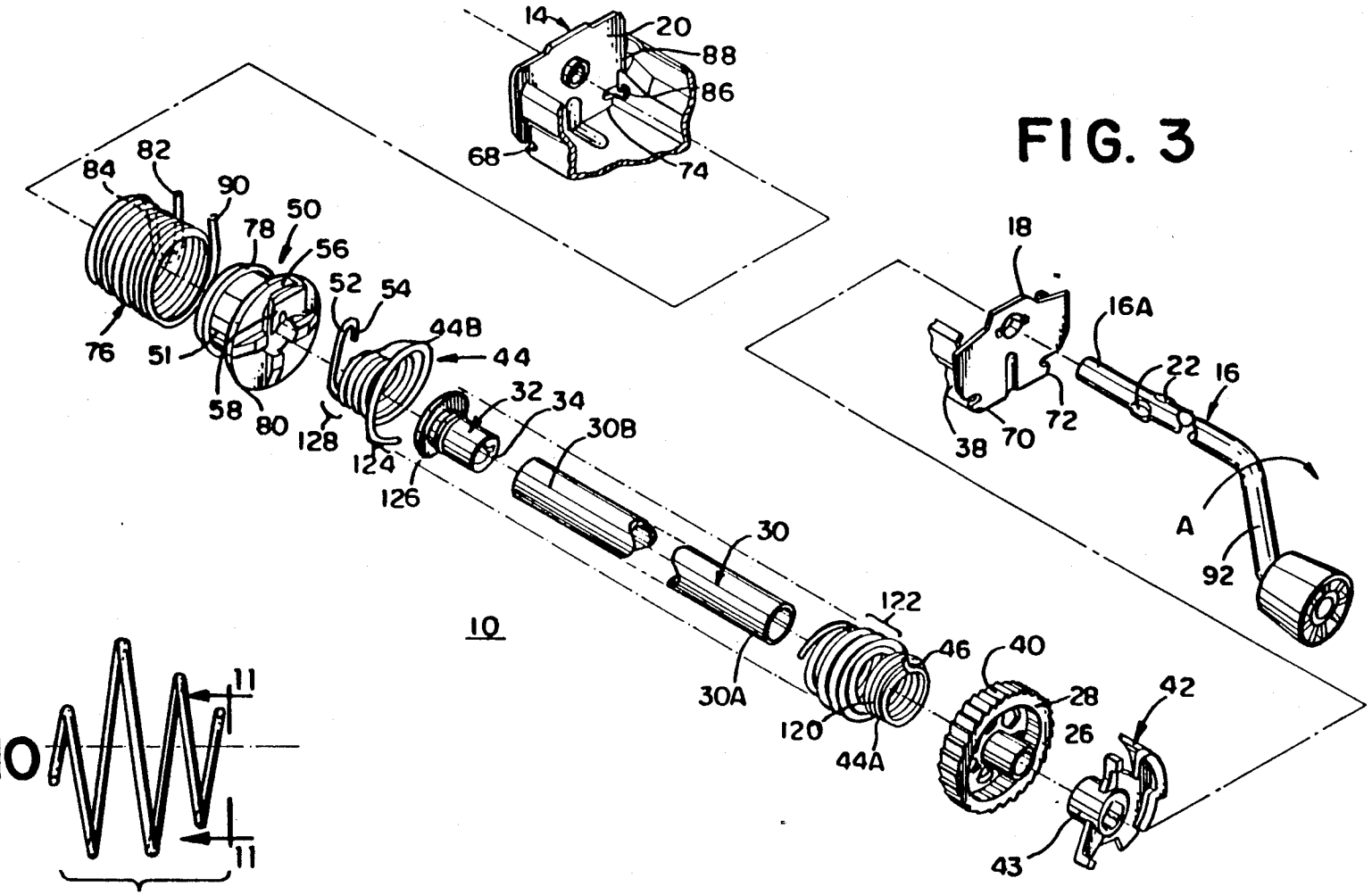
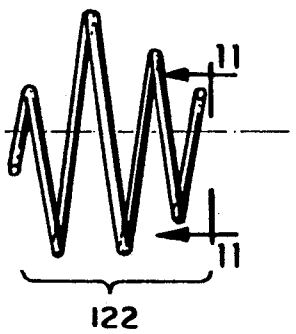
FIG.10

LOBE SPRING MOTOR FOR CHILD'S SWING

BACKGROUND OF THE INVENTION

The invention is directed to spring motors, particularly lobe spring motors suitable for use in a child's swing like the type disclosed in U.S. Pat. No. 4,165,872 and other uses. The preferred embodiment of the present invention further optimizes the safety and reliability of the spring motor, enables the motor to be wound silently and is believed to be the first spring motor of its type to include a lobe power spring for increased energy storage capacity.

Prior art spring motors, such as that disclosed in U.S. Pat. No. 4,165,872, typically utilize a torsion spring having a multiplicity of coils of substantially uniform radii. At various times, attempt have been made to increase the amount of energy which can be stored in the torsion coil spring provided in such motors to extend the uninterrupted operation of the swing. For example, U.S. Pat. No. 3,804,407 describes a spring motor utilizing a pair of torsion coil springs, one located concentrically within the other, to increase the amount of energy which can be stored in a given volume. While the double spring motor of the aforesaid patent increased the energy storage capacity per unit volume of space allocated to the spring of the motor, it required an intricate hand assembly of the two power springs, a connector and an extra pusher spring, which has been found less desirable for mass production.

German Patent No. 626,739 discloses a rotary switch incorporating a torsion coil spring 4 in which coils vary progressively in radii at right angles to the central axis of the spring along the axis of the spring to form a pair of lobes. The spring 4 is surrounded by a housing 3 including a pair of parallel walls 5 and 6 connected to each other by cross pieces. The spring 4 is substantially coaxial with and mounted over a switch cylinder 2 located on a switch axle 1. In the relaxed state, the spring 4 forms the two lobes depicted in FIG. 1.

When coils of differing radii are used along a torsion coil spring, there is the danger that the coils may become overlapped and lock the spring, preventing further rotation of the spring to store more energy or release of that energy from the spring. The German reference suggests that it is the first to disclose the enclosing of an entire such spring in a switch.

When loaded, the spring 4 in the German reference is compressed axially such that the coils which make up the outer cone of one of the two lobes come into contact with one wall 5 and the coils which make the other exterior cone of the other lobe come into contact with the other wall 6. In addition, the distance between the connecting walls 5 and 6 is selected so that each of the remaining coils of each inner cone come into contact with several coils of the neighboring inner cone so that the coils sit in contact without jamming. Ends 8 and 9 of the spring 4 extend radially from the housing 4 so that, depending upon the direction of rotation of the switch cylinder, one tang of the spring 4 is engaged by cross piece 7 while the other tang is engaged by means 10 coupled with the switch axle 1. That mounting configuration permits only a single rotation or wind of the spring 4, at which time both tangs are caught between the cross piece 7 and attachment means 10. The German reference neither teaches nor suggests either the configuration of a device with such a spring which permits more than a single rotation of the spring without jamming in order that the spring may effectively be used as a motor.

Prior art spring motors, such as that disclosed in U.S. Pat. No. 4,165,872, typically utilize an escapement including a ratchet wheel, dog, pawl and actuator as an output drive of the motor. The ratchet wheel of the escapement is drivingly coupled to a crankshaft. A power spring is secured at one end to a carriage and at another end to the ratchet wheel. The carriage oscillates within a canopy mounted on the swing legs. The power spring is both wound and unwound through the ratchet wheel. As the spring is wound up, by rotating the crankshaft, the ratchet wheel turns. The ratchet wheel teeth strike the pawl, producing a repetitive, clacking sound which can be quite annoying. In the case of a child's swing or cradle, the sound may waken a child who has been lulled to sleep.

If the escapement has been tampered with in spring motors of the type described in U.S. Pat. No. 4,165,872, the dog and pawl may disengage from the ratchet wheel whereby the spring may unwind uncontrollably, spinning the ratchet wheel and therefore the crankshaft. Rapid, uncontrolled rotation of the crank arm portion of the crankshaft may pose a safety hazard to anyone in its vicinity.

The problems solved by the preferred embodiment of the present invention are those of increasing the energy storage capacity of a spring motor while further permitting winding of the power spring substantially without noise and precluding rapid, uncontrolled rotation of the crank arm by unintended unwinding of the power spring.

SUMMARY OF THE INVENTION

The invention is a spring motor which comprises a power spring formed from a wire having a pair of ends, a multiplicity of coils between the ends and a plurality of lobes. Each lobe is defined by a plurality of the adjoining coils of the spring. At least some of the coils of each lobe change in radii with respect to a central longitudinal axis of the spring as the coils extend along the axis of the spring to define the lobe. The motor further comprises input means for winding the power spring a plurality of times to tighten the coils, and drive means coupled with an end of the power spring for rotating with the power spring when the power spring unwinds. The spring motor is preferably incorporated into a child's swing.

BRIEF DESCRIPTION OF THE DRAWINGS

The foregoing summary, as well as the following detailed description of the preferred embodiments of the invention, will be better understood when read in conjunction with the appended diagrammatic drawings. For the purpose of illustrating the invention, there is shown in the drawings embodiments which are presently preferred. It should be understood, however, that the invention is not limited to the precise arrangements and instrumentalities shown. In the drawings:

FIG. 1 is a front elevation view of a motor operated swing in accordance with the present invention;

FIG. 3 is an exploded view of the spring motor of FIG. 2;

FIG. 6 is a transverse cross sectional view the spring motor taken along the lines 6—6 of FIG. 2;

FIG. 7 is a detailed expanded view taken along the lines 7—7 of FIG. 6;

FIG. 10 depicts diagrammatically the plurality of coils forming one of a plurality of identical lobes of the spring of the motor in an unloaded or relaxed state and stretched out for visualization purposes;

DETAILED DESCRIPTION OF THE PREFERRED EMBODIMENT

Figure 2:
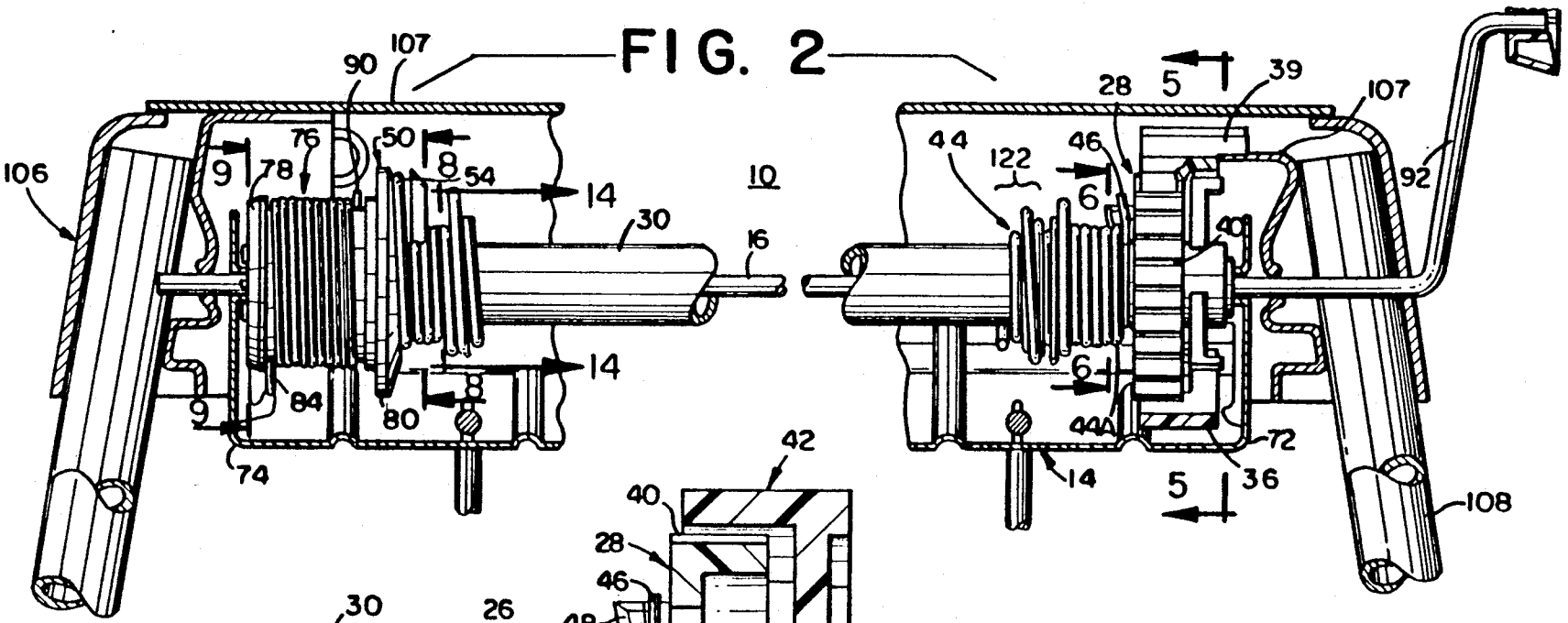
FIG. 2 is an enlarged, broken away front elevation view of a portion of the swing of FIG. 1 depicting details of the spring motor and mounting of the motor to the swing.
Figure 4:
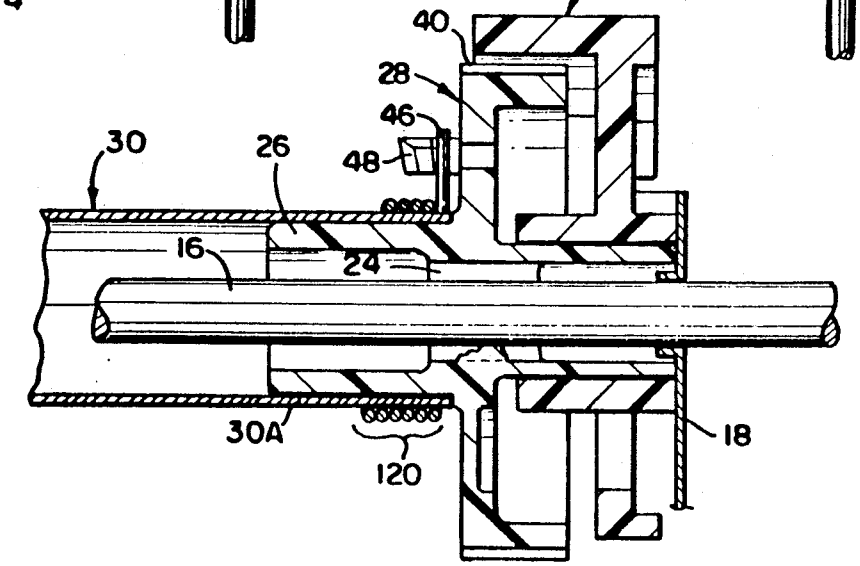
FIG. 4 is a partially cross sectioned view taken along the lines 4—4 of FIG. 5.

Referring to the drawings, wherein like numerals indicate like elements, there is shown in FIG. 1 a child's swing indicated generally at 12 in accordance with the present invention. A spring motor is mounted inside a carriage 14 which supports a swing seat 100 on chains 102 and rods 104. The motor is wound through handle 92 of crankshaft 16. The carriage 14 oscillates within a canopy 106 fixedly mounted on the swing legs 108. The elements depicted in FIG. 1 are conventional structures well-known to those of skill in the art and are described in at least U.S. Pat. Nos. 2,807,309 and 4,165,872 incorporated by reference herein.

Figure 5:
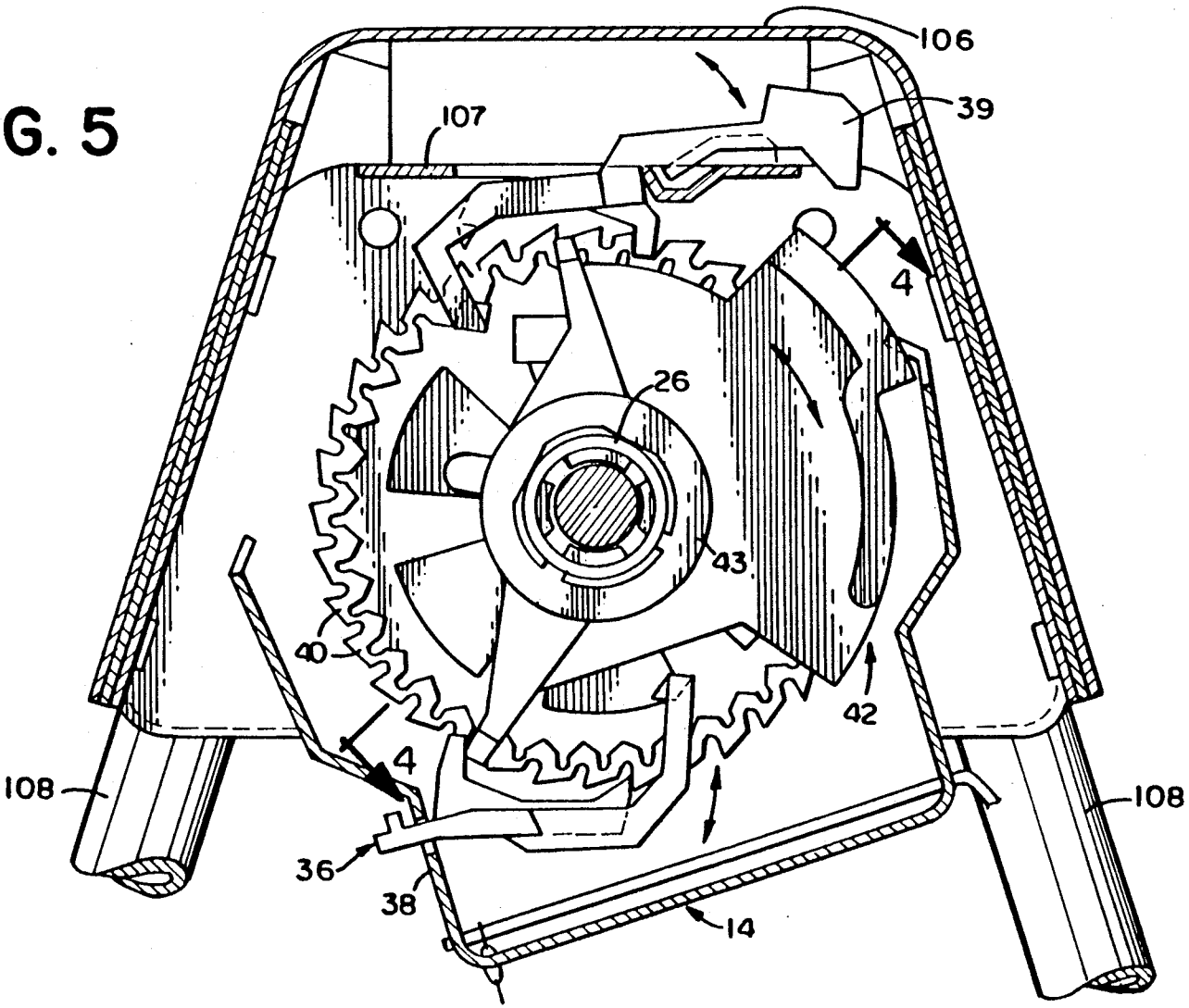
FIG. 5 is a transverse cross sectional view of the spring motor taken along the lines 5—5 of FIG. 2.
Figure 8:
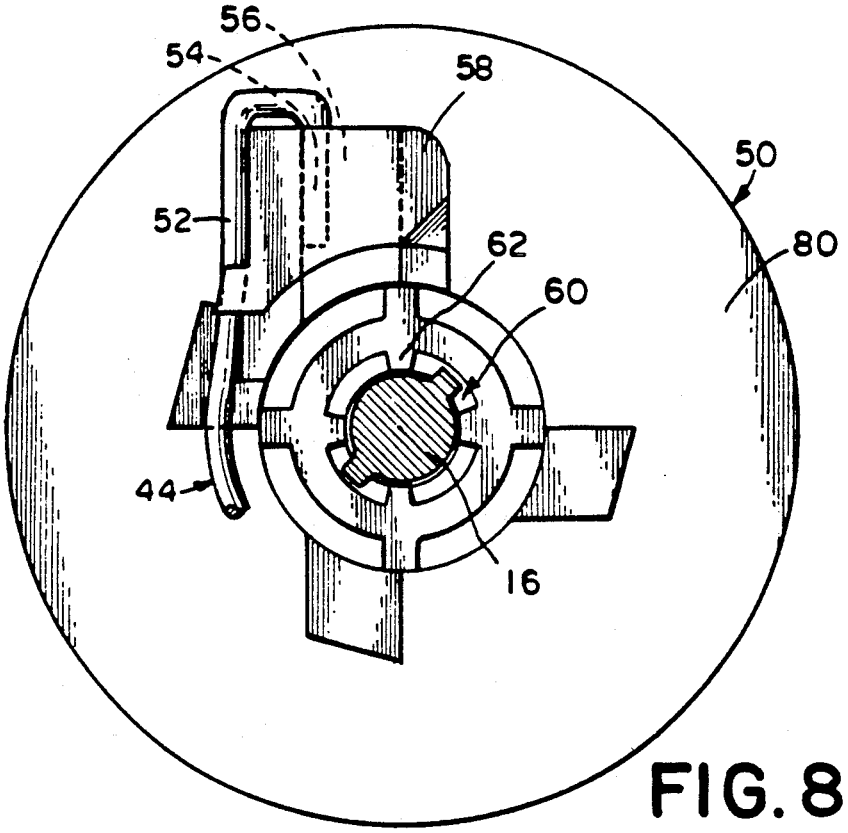
FIG. 8 is a transverse cross sectional view of the spring motor taken along the lines 8—8 of FIG. 2.
Figure 9:
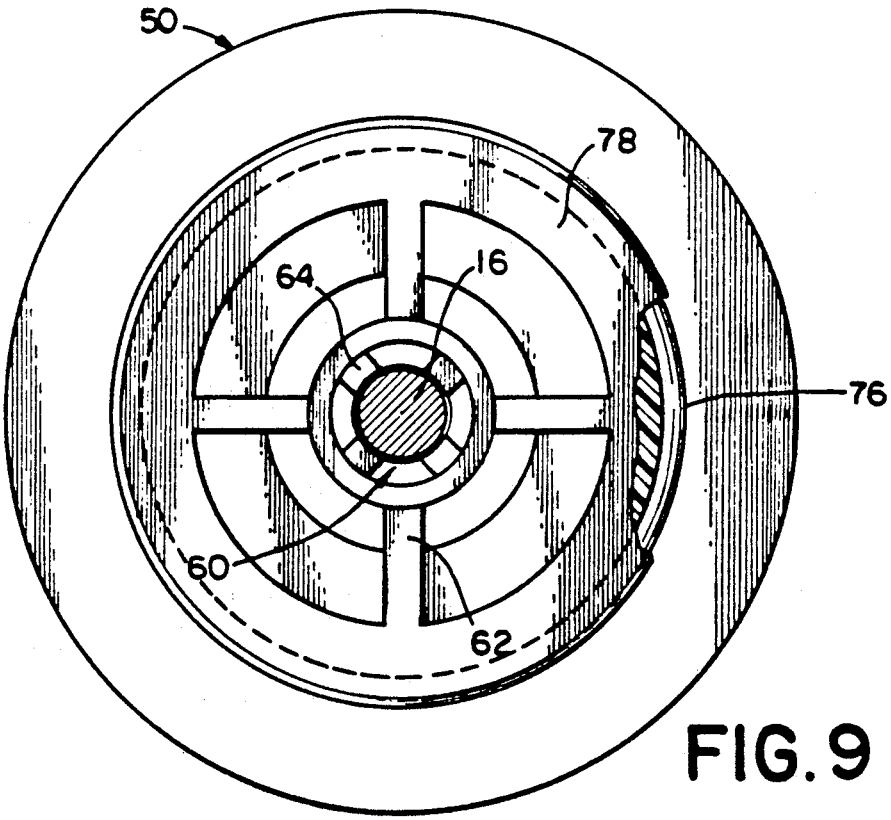
FIG. 9 is a transverse cross sectional view of the spring motor taken along the lines 9—9 of FIG. 2.

The remaining figures depict a preferred spring motor 10 of the present invention and its various components. The motor 10 is preferably mounted in carriage 14. Referring to various ones of the FIGS. 2 through 9, the motor 10 comprises the steel crankshaft 16 journaled in carriage end plates 18, 20 which rotatably support the shaft 16 at opposing ends of the motor 10. The crankshaft 16 is provided with a pair of crankshaft ears 22 which fit within or pass through a keyway 24 formed in the hub 26 of an escape or ratchet wheel 28. A mandrel in the form of a steel tube 30 is secured at one end portion 30A to the ratchet wheel 28, preferably by staking as shown in FIG. 5 of U.S. Pat. No. 3,804,407, also incorporated by reference in its entirety. A bearing 32 is press fitted within tube 30 at an opposite end portion 30B thereof. The bearing 32 is preferably made of Celcon TM and is provided with a keyway 34 through which the crankshaft ears 22 can pass.

Preferably, the spring motor 10 includes in addition to the escape wheel 28, a dog 36, pawl 39 and actuator 42 forming an escapement. Dog 36 is mounted on a side wall 38 of carriage 14 while pawl 39 is mounted on a flange portion of inside end plate 107 of canopy 106 so as to engage the teeth 40 on ratchet wheel 28. Actuator 42 includes a hub 43 and is mounted on the ratchet wheel hub 26. The escapement of the present invention is in many respects similar in structure and operation to well-known escapements described, for example, in U.S. Pat. No. 4,165,872. However, unlike the escapement described in U.S. Pat. No. 4,165,872, the ratchet wheel 28 of the present motor is not drivingly coupled to the crankshaft 16 but, instead, is mounted on the crankshaft 16 in free bearing engagement therewith. Thus, the ratchet wheel 28 and crankshaft 16 may be said to be disengaged and are free to rotate separately with respect to each other at end portion 44A of the spring.

The power spring 44 is coupled at one end portion 44A to the ratchet wheel 28 and is generally supported on and centered with respect to the mandrel provided by tube 30. More specifically, spring end tang 46 is coupled to the ratchet wheel 28 by a resilient lug 48 on the ratchet wheel 28 whereby the spring 44 rotates or turns the ratchet wheel 28 as the spring 44 unwinds. The opposite end portion 44B of the power spring 44 is coupled to a drum or spool 50. More specifically, end tang 52 is provided with a hook-shaped portion 54 which is received in a recess 56 formed in a lug 58 on the drum body. Accordingly, when drum 50 is turned in the direction of arrow A in FIG. 3 it winds the power spring 44 at end portion 44B in a direction tightening its coils.

Preferably, the drum 50 is a pre-molded unitary piece made of Celcon TM and is provided with a spider 60 having ribs 62 facing radially inwardly. The crankshaft ears 22 engage the drum spider ribs 62 so as to drivingly couple the crankshaft and drum. The end portion 16A of the crankshaft extending beyond the ears 22 is journaled into a second set of radially inwardly extending ribs 64 integral with spider 60. The ribs 64 are shifted forty-five degrees from ribs 62 such that the inside faces of the ribs 64 form a stop for the crankshaft ears 22.

Preferably, the carriage 14 is made of sheet metal and is drawn spherical at the corners 68, 70, 72 and 74.

A second coil spring 76 is mounted on the cylindrical barrel portion of drum 50 and is retained thereon by annular end flange 78 and annular shoulder 80. An end tang 82 of coil spring 76 is provided with a hook-shaped portion 84 which is secured within a pair of notches 86, 88 formed in the carriage proximal corner 74. Coil spring 76 is wrapped around the drum barrel portion so that the remaining end tang 90 is readily accessible for inspection and manipulation (to release the drum 50 and unwind the power spring 44) before the carriage 14 is opened by factory personnel. The end portion 30B of tube 30 is journaled in drum 50 whereby the drum 50 and tube 30 are free to rotate separately with respect to each other.

In operation, drum 50 and coil spring 76 form a lock clutch which permits the crankshaft 16 and the drum 50 to be rotated in one direction only, the direction of arrow A in FIG. 3, to wind the power spring 44 in one direction which tightens the coils of the spring 44, thereby loading the spring 44. To wind the power spring 44, the user grips the crank arm 92 so as to rotate the crankshaft 16 in the direction indicated by arrow A. One-way rotation of the drum 50 in the direction of arrow A, causes lock coil spring 76 to unwind and expand radially outwardly, thereby providing sufficient looseness between the spring 76 and the barrel portion of drum 50 whereby the drum 50 is free to rotate under power of the crankshaft 16 without noticeable resistance. As the drum 50 turns in the direction of arrow A, the power spring 44 winds. As the power spring 44 winds, however, the ratchet wheel 28 is unaffected since there is no driving connection between the crankshaft 16 and ratchet wheel 28. The remaining elements of the escapement prevent the ratchet wheel 28 from rotating until the carriage 14 is externally oscillated.

If the crankshaft 16 is wound in the direction of arrow A and then released, drum 50 will remain in the position to which it had been advanced under power of the crankshaft 16. Thus, when the crankshaft 16 is released, coil spring 76 contracts radially inwardly or winds so that there is no clearance between the coil spring 76 and the drum barrel portion 51. The coil spring 76 clamps or locks the drum 50 along its barrel portion 51 thereby locking the drum 50 against reverse rotation (in a direction the reverse of arrow A). Any tendency of power spring 44 to unwind at end portion 44B and turn drum 50 in the reverse direction (the reverse arrow of A), is opposed by the locking force applied by coil spring 76 to the drum barrel portion 51. Thus, the lock clutch therefore prevents the power spring from unwinding at end portion 44B, and prevents handle spin-off.

As previously mentioned, coil spring 76 tends to unwind so as to provide sufficient clearance between the coil spring 76 and the exterior surface of the drum barrel portion whereby the drum 50 may be advanced by the crankshaft (in the direction of arrow A), without noticeable resistance, to wind the power spring 44. Preferably, the cross-section of the coil spring 76 is circular and the exterior surface of the barrel portion of drum 50 is sufficiently smooth so that, should one or more loops of the coil spring 76 remain in contact with the drum 50, any resistance to one-way rotation of the drum 50 is minimal. The coil spring 76 may be made of 0.072 music wire and may have an unwound or unload diameter approximately 40 mils less than the outer diameter of the barrel portion 51 on which it is mounted.

Due to its construction and manner of operation, the lock clutch produces virtually no noise as drum 50 is turned to wind the power spring 44. This is to be contrasted to the devices of the prior art, U.S. Pat. No. 4,165,872 being representative, wherein the ratchet wheel is driven by the crankshaft as the power spring is being wound. In such a device, the ratchet wheel teeth repeatedly strike the dog as the power spring is being wound thereby producing an annoying, clacking sound. In the present invention, the ratchet wheel 28 is only used as part of an escapement and is not rotated by the crankshaft 16 during wind up of the power spring 44.

The lock clutch also provides a different lock than the ratchet, dog and pawl of the prior art represented by U.S. Pat. No. 4,165,872 to prevent reverse rotation of the crankshaft (in the reverse of the direction of arrow A). Thus, in the prior art device shown in U.S. Pat. No. 4,165,872, if the dog and pawl disengage from the ratchet wheel the tendency of the power spring to unwind will be unopposed. Since the power spring in the prior art device winds and unwinds at the same end portion, i.e., the portion coupled to the ratchet wheel, the spring can turn the ratchet wheel uncontrollably as it unwinds. And since the crankshaft is drivingly coupled to the ratchet wheel in the prior art device, the unwinding spring can cause the crankshaft to turn uncontrollably at high speed in the reverse direction (reverse of the direction of arrow A).

This is avoided by the present invention because the ratchet wheel 28 and crankshaft 16 are not drivingly engaged. If the dog 36 and pawl 39 do not align properly with the ratchet wheel teeth 40, so that the ratchet wheel 28 is unlocked and the power spring 44 is free to unwind, the crankshaft 16 will not be affected. That is, the unwinding power spring 44 will spin the ratchet wheel 28 but the crankshaft 16 will not turn. Thus, the crank arm 92 will pose no external danger to a child or other person.

Preferably, the drum ribs 62 are formed so as to break away at approximately 130 inch-pounds torque applied by the crankshaft 16 in the reverse rotation direction (reverse of the direction of arrow A). This will protect the lock clutch spring 76 from damage should the crankshaft 16 be mistakenly turned in the reverse direction with excessive force by the user.

The danger posed to the clutch spring by the application of excessive torque on drum 50 in the reverse rotation direction (reverse of arrow A) may also arise when the power spring 44 is overwound. The power spring 44 may be overwound, for example, due to the combination of continuous winding and "high swinging". To protect the clutch spring 76, the tang securement lug 58 is formed on the drum 50 so as to allow the hook 54 on the tang of the spring 44 to break away from the drum 50 at approximately 125 inch-pounds. When the hook 54 breaks away from the drum 50, end tang 52 is released whereby the power spring 44 is free to unwind rapidly at end portion 44B inside the carriage 14. However, the crankshaft 16 remains unaffected. Thus, no danger is posed to the child or other person in the vicinity of the crank arm 92.

In the present invention, power spring 44 is wound by the drum 50 at end portion 44B and unwound under control of the ratchet wheel 28 at opposite end portion 44A. The escapement further comprising the dog 36, pawl and actuator 42, functions as described in U.S. Pat. No. 4,165,872 to control or regulate the unwinding of the power spring 44 in predetermined increments. However, unlike the device described in U.S. Pat. No. 4,165,872, the escapement plays no part in winding the power spring 44.

The preferred power spring 44 of the present invention is formed from a wire having the pair of ends 46 and 52 and a multiplicity of coils between those ends. The coils have the same direction of coiling along the axial length of the spring 44. The spring includes at end portion 44A adjoining mounting tang 46, a plurality of adjoining mounting coils 120, of substantially identical, uniform radii with respect to a central longitudinal axis of the spring 44, extending through the coil 44 in FIG. 3. Immediately adjoining the plurality of mounting coils 120 is the first of a plurality of lobes, preferably seventy, defined along the spring 44 by the coils. Each lobe includes a plurality of adjacent coils of the spring. At least some of the coils of each lobe change in radius with respect to the central longitudinal axis of the spring as the coils extend along the spring to define the lobe. Preferably, the seventy lobes include sixty-nine substantially identical power lobes 122 and a single washer lobe 124. A washer 126 is positioned along the tube 130 within the washer lobe 124. A last plurality of coils 128 at end 44B of spring 44, adjoining the washer lobe 124, form part of a slip clutch on the mandrel formed by tube 30.

Briefly, mounting coils 120 are provided to space from the ratchet wheel 28 and other components of the escapement, the coils of the closest power lobe 122. Preferably, about five mounting coils 120 are provided. Power lobes 122 permit significantly more winding of power spring 44 than can be accomplished by a similar spring of similar material having a similar volume and coils of a uniform diameter. Washer 126 is provided to prevent the coils of the power lobe 122 immediately adjoining the slip clutch coils 128 from wrapping around the slip clutch coils 128 and causing one or more of them to seize the tube 30 prematurely. The washer lobe 124 is provided to prevent the spring 44 from seizing the washer 126 where that spring 44 overlaps the washer 126. Approximately two coils are all that are required for the washer lobe 124. The slip clutch coils 128 permit the winding of the spring 44 until a predetermined degree of wind or torque is stored within the spring 44, at which time the coils 128 are tightened sufficiently to seize the tube 30, preventing further rotation of the tube or winding of the spring 44. Preferably, the slip clutch coils 128 are sized to seize the tube 30 when the power spring 44 is tightened to its desired maximum load, which is preferably about twenty in./lbs. or less in a child's swing application. The slip clutch coils 128 have the smallest radii of any of the coils of the spring 44. Three such coils 128, for example, will suffice.

Figure 11:
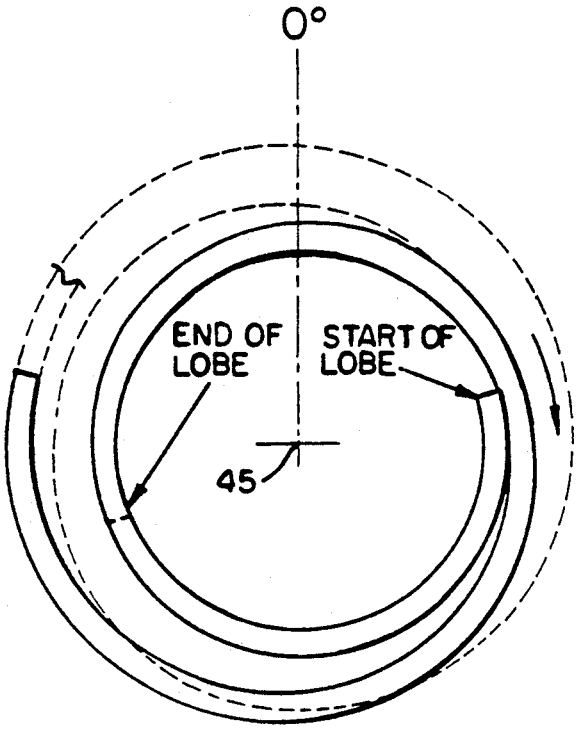
FIGS. 11-12 are consecutive, transverse cross-sectional views of the lobe of FIG. 10 beginning along the lines 11—11.
Figure 12:
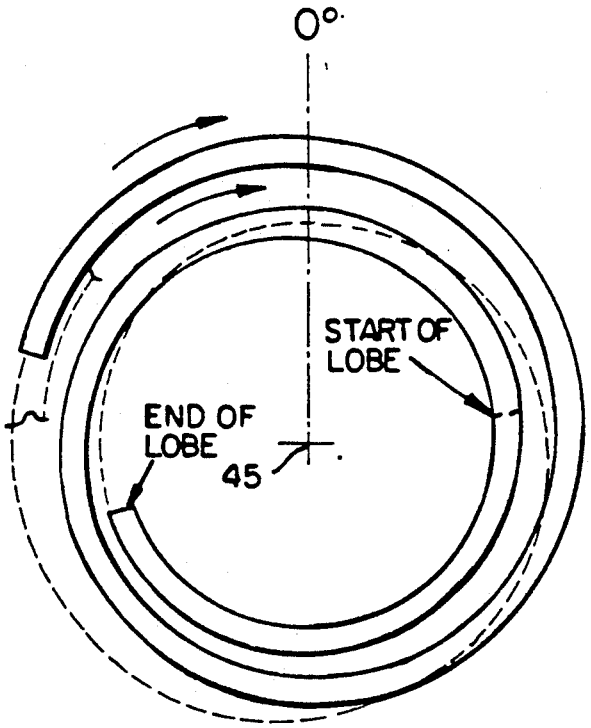

The plurality of adjoining coils forming one of the substantially identical power lobes 122 are depicted diagrammatically in FIGS. 10 through 12 in a relaxed or unloaded state. The figures illustrate in longitudinal and radial views the increase and decrease in radii of the coils with respect to the central longitudinal axis 45 of the spring 44 as the coils defining the lobe 122 extends along the spring 44. In the preferred embodiment spring 44, each of the power lobes 122 is defined by approximately three-and-one-half adjoining coils. Those coils vary in radii from an original radius approximately equal to the radius of the mounting coils 120 (FIG. 3) to a maximum radius approximately forty percent greater and back to the original radius (FIG. 12). The two coils forming the washer lobe 124 vary from the nominal radius of the adjoining slip clutch coils 128 and the original radius of the adjoining power coil 122, to a maximum radius about one-half to two-thirds greater than each of those radii. Again, the uniform radii of the slip clutch coils 128 are approximately equal to but uniform radii of the mounting coils 120 and the original radii of the coils of the power lobes 122.

Figure 13:
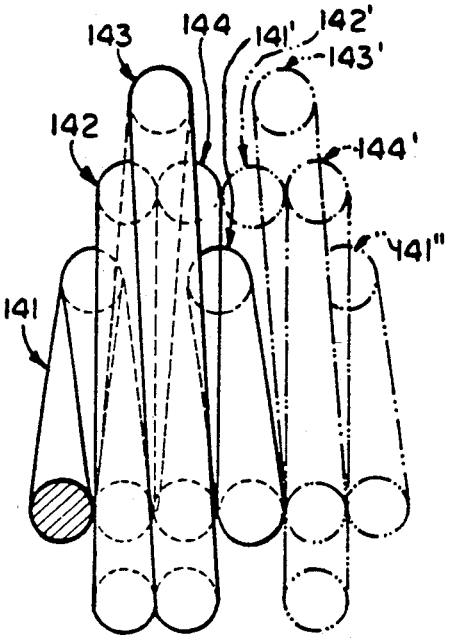
FIG. 13 is a diagrammatic view of a lobe of the spring in a loaded or compressed state.
Figure 14:
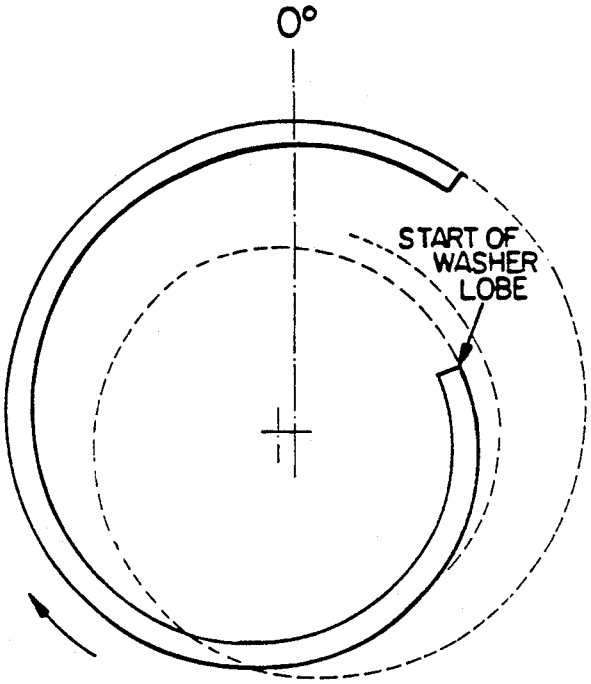
FIGS. 14 and 15 are consecutive transverse cross-sectional views, like FIGS. 11 and 12, of a washer lobe portion of the power spring beginning approximately along the lines 14—14 of FIG. 2.
Figure 15:
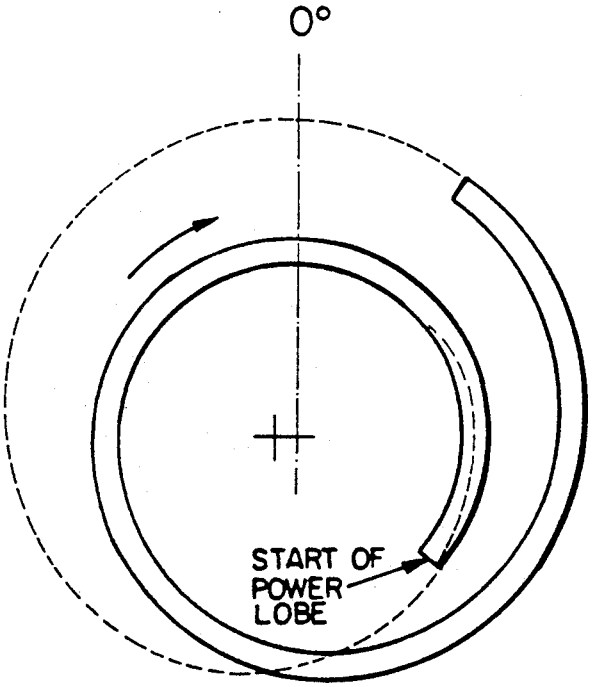

FIG. 13 depicts diagrammatically how coils of a lobe-type power spring seat within one another when such spring is tightly wound on a mandrel. Four consecutive coils of a power lobe 122 are numbered 141-144 in FIG. 13. The first coil is of a substantially uniform radius. Coil 142 has a greater radius and encircles coil 141. Coil 143 has an even greater radius and encircles coils 141 and 142. Coil 144 is substantially the mirror of coil 142 and, in the fully compressed state, abuts coil 142 within coil 143. Coil 144 is then followed by the first coil 141' of the next lobe. Coil 141' is encircled on one side by coil 144 of the initial lobe and by a coil 142' in its lobe. Thus, each power lobe preferably consists of one coil 141 overlapped by other coils 142, 144 which are, in turn, overlapped by an outer coil 143 moving sideways along the lobe and underlapped by the other coils 142, 144. As can be seen by careful study of coils 142 and 144, which immediately adjoin coils 142' and 144' of the next lobe on the tightened spring, that a tight lobe is effectively only two coils wide yet contains four coils 141-144. It is possible to pick up about one complete wind of rotation of the spring 44 per lobe 122 without any increase in the axial length of the spring 44 from its unwound length.

Undesired cocking and overlapping of the coils of lobes 122 are further controlled by proper sizing of the coils of the lobes 122 with respect to one another and with respect to the diameter of tube 30. In the presently preferred embodiment, the outer diameter of the tube 30 is suggestedly at least about three-quarters of an inch. In a fully wound state, the innermost coils 141 of each power lobe 122 preferably have an inner diameter approximately seventy mils greater than the outer diameter of the tube 30, while the outer surface of the intermediate coils 142 of the lobes 122 are radially spaced approximately thirty to forty thousandths of an inch from the adjoining surfaces of the innermost coils 141 and outermost coils 144. These dimensions prevent the coils 141-144 from grabbing the tube 30 before it is grabbed by coils 128 of the slip clutch, and are small enough to hold a random tiling of the coils to a practical limit when the spring is relaxed. In the unwound or relaxed state of the preferred spring 44, the inside radii of the slip clutch coils 128 are slightly less than one-half inch, the radii of the mounting coils 120 and the minimum radii of the coils of the power lobes 122 are slightly larger than the radii of the slip clutch coils 128. The maximum radii of the coils forming each power lobe 122 are about one-and-two-thirds inches, while the maximum radii of the washer lobes is about one-and-three-quarters inch. Preferably, spring 44 is formed by a circular, hardened steel spring wire, about eighty mils in diameter. Preferably, the outer diameter of washer 126 should be large enough to prevent the washer lobe 124 and the power lobe 122 from overlapping the slip clutch coils 128 and grabbing them. Preferably, the inner diameter of the washer 126 is at least about fifty mils greater than the outer diameter of tube 30 to prevent cocking and locking of the washer 126 on the tube 30. To further prevent locking of the washer 126 by spring 44 the maximum outside radius of the washer lobe 124 should be at least about fifty percent greater than the outer radius of the washer 126.

It has been found that a power spring 44 of the type described, approximately twelve-and-one-half inches long, can be initially wound approximately fifty turns and, after repetitive windings and tightening of the power spring 44, about forty-five turns before the slip clutch coils 128 seize the tube 30. In comparison, prior motors with springs of comparable size but uniform radius coils can be initially wound only about twenty-eight times and, after repetitive winding and tightening of the spring, only about twenty-two times before maximum torque is reached. Accordingly, the spring motor of the present invention provides approximately twice the winds and consequently, twice the number of swings that conventional spring motors provide.

While ratchet wheel 28 constitutes one type of rotary output or drive means coupled to the one end 44A of the spring 44 for rotating with the one end when the spring 44 unwinds, one of ordinary skill in the art will appreciate that other types of drive members including shafts, tubes, gears, wheels, capstans, pulleys, sprockets, clutches, etc. can be coupled directly to the end of the spring 44, permitting the spring 44 to be controllably unwound for performing work with the motor.

While the preferred motor 10 is wound through the crankshaft 16 and spool 50 at end 44B of the power spring 44, one of ordinary skill will appreciate that one end of the spring 44 can be fixedly clamped to the carriage 14 or other stationary member and the spring wound and unwound at the same end, that is, the opposite end from the end fixedly clamped, as is disclosed, for example, in the aforementioned U.S. Pat. No. 4,165,872. There, the power spring was wound through a crankshaft rotationally engaged with the ratchet wheel and unwound through the ratchet wheel.

While the preferred motor is preferably intended for use in a child's swing (seat or cradle), one of ordinary skill will appreciate that the motor 10 can, through various conventional transmission devices, be used to perform work in a virtually countless variety of ways either directly through a drive member coupled with the spring or through a train, coupling or linkage. The latter can be designed to provide virtually any desired type of motion including, for example, in addition to the reciprocating motion disclosed for swing 12, rotary, vibratory, oscillatory and linear and nonlinear translational motions.

One of ordinary skill will appreciate that the slip clutch formed by tube 30 and coils 128 of the present invention is not absolutely required. However, one should appreciate that the slip clutch mechanism described constitutes the first known practical mechanism for controlling a lobe spring of the type disclosed and permitting the spring to be wound a plurality of times without premature overlapping and locking of the coils. As a result, it constitutes the first practical solution to incorporating a lobe-type spring into a motor.

While preferred embodiments have been described and other embodiments suggested, one of ordinary skill will appreciate that the present invention may be embodied in still other specific forms without departing from the spring or essential attributes thereof. Accordingly, reference should be made to the appended claims, rather than to the foregoing specification, as indicating the scope of the invention.

I claim:

1. A spring motor comprising:

a power spring formed from a wire having a pair of ends, a multiplicity of coils between the ends, and a plurality of lobes, each lobe being defined by a plurality of the adjoining coils of the spring, at least some of the coils of each lobe changing in radii with respect to a central axis of the spring as the coils extend along the spring to define the lobe;

means for winding the power spring a plurality of times to tighten the coils: and drive means coupled with one end of the power spring for rotating with the one end of the power spring when the power spring unwinds.

2. The spring motor of claim 1 further comprising a mandrel extending longitudinally through the power spring supporting the power spring.

3. The spring motor of claim 2 wherein at least one of the coils of the power spring has a uniform radius smaller than any radii of the coils defining the lobes of the power spring and forms a slip clutch for seizing the mandrel when the power spring is sufficiently tightened.

4. The spring motor of claim 3 further comprising a washer movably positioned on the mandrel between the plurality of slip clutch coils and a remaining portion of the spring.

5. The spring motor of claim 4 wherein the lobes includes a washer lobe extending from the plurality of slip clutch coils over the washer to the coils of a first of a plurality of substantially identical adjoining power lobes and wherein the washer lobe has a maximum radius at least as great as the greatest radii of any of the coils of the plurality of adjoining power lobes.

6. The spring motor of claim 1 wherein the means for winding comprises lock clutch means at a remaining one of the pair of ends of the power spring, the lock clutch means permitting winding of the power spring only in a first direction tightening the coils.

7. The spring motor of claim 6 wherein the lock clutch means comprises a spool coupled with the remaining end of the coil spring and a second coil spring wrapped about the spool.

8. The spring motor of claim 7 wherein the means for winding further comprises a shaft extending rotatably through the power spring and rotatably engaging the spool.

9. The spring motor of claim 8 wherein the drive means comprises an escape wheel coupled with the one end of the power spring.

10. The spring motor of claim 1 wherein the drive means is an escape wheel coupled with the one end of the power spring and further comprising a pawl, a dog and an actuator in an escapement with the escape wheel.

11. The spring motor of claim 1 in a combination further comprising:

a carriage receiving the spring motor; and a child's swing coupled to the carriage.

12. The combination of claim 11 further comprising escapement means for oscillating the carriage and the child's swing, the escapement means including the drive means.

13. The spring motor of claim 12 further comprising a mandrel extending longitudinally through the power spring supporting the power spring.

14. The spring motor of claim 13 wherein at least one of the coils of the power spring has a uniform radius smaller than any radii of the coils defining the lobes of the power spring and forms a slip clutch for seizing the mandrel when the power spring is sufficiently tightened.

15. The spring motor of claim 14 further comprising a washer movably positioned on the mandrel between the plurality of slip clutch coils and a remaining portion of the spring.

16. The spring motor of claim 15 wherein the lobes includes a washer lobe extending from the plurality of slip clutch coils over the washer to the coils of a first of a plurality of substantially identical adjoining power lobes and wherein the washer lobe has a maximum radius at least as great as the greatest radii of any of the coils of the plurality of adjoining power lobes.

17. The spring motor of claim 16 wherein the means for winding comprises lock clutch means at a remaining one of the pair of ends of the power spring, the lock clutch means permitting winding of the power spring only in a first direction tightening the coils.

18. The spring motor of claim 17 wherein the lock clutch means comprises a spool coupled with the remaining end of the coil spring and a second coil spring wrapped about the spool.

19. The spring motor of claim 18 wherein the means for winding further comprises a shaft extending rotatably through the power spring and rotatably engaging the spool.

20. The spring motor of claim 19 wherein the drive means comprises a toothed escape wheel coupled with the one end of the power spring and forming part of the escapement means.

* * * * *